United States Patent [19]

Stafford

[11] 4,356,212

[45] Oct. 26, 1982

[54] METHOD AND APPARATUS FOR TREATING TEXTILE CORD

[75] Inventor: Willie M. Stafford, Hartselle, Ala.

[73] Assignee: The Goodyear Tire & Rubber Company, Akron, Ohio

[21] Appl. No.: 255,961

[22] Filed: Apr. 20, 1981

[51] Int. Cl.[3] ..... B05D 3/12; B05C 3/152; B05C 11/10

[52] U.S. Cl. ..... 427/175; 118/33; 118/103; 118/117; 118/122; 118/124; 118/126; 118/420; 118/DIG. 19; 118/DIG. 22; 427/176; 427/356; 427/365; 427/434.6

[58] Field of Search ..... 118/33, 103, 117, 122, 118/124, 420, 126, DIG. 19, DIG. 22; 427/356, 358, 175, 176, 365, 434.6

[56] References Cited

U.S. PATENT DOCUMENTS

| | | | |
|---|---|---|---|
| 1,778,733 | 10/1930 | Sjodahl | 118/117 X |
| 2,159,587 | 5/1939 | Greider et al. | 118/124 X |
| 2,637,659 | 5/1953 | Miller | 118/DIG. 19 X |
| 3,113,886 | 12/1963 | Kolb | 118/33 X |

*Primary Examiner*—Evan K. Lawrence
*Attorney, Agent, or Firm*—H. C. Young, Jr.

[57] ABSTRACT

A method and apparatus for treating textile cord on a continuous basis where the cord is sequentially treated by application of aqueous solution passed through a squeeze roll station, passed through a pull roll station and then to a drying operation. The applied liquid is additionally removed from the cord by specially positioned and designed elastomeric squeeges located in the squeeze roll area and the pull roll area.

2 Claims, 3 Drawing Figures

METHOD AND APPARATUS FOR TREATING TEXTILE CORD

FIELD

This invention relates to a method and apparatus for treating cords and particularly for treating pneumatic rubber tire reinforcement cord with liquid.

BACKGROUND

Conventionally cords of various materials are used as reinforcement in tires, belts, hose and various other articles manufactured from rubber or other elastomeric materials. Such cords are generally composed of at least one twisted yarn and more typically a plurality of twisted yarns cabled together.

The adhesion of the cord to rubber or other materials is generally enhanced by applying an adhesive to the cord. The adhesive can usually be applied to the cord in liquid form such as an aqueous mixture or emulsion from which the water is then removed, usually through evaporation by application of heat.

However, in a continuous cord-adhesive process, where the cord is sequentially passed, under tension, through an aqueous adhesive dip, over and around squeeze rolls to squeeze out a major portion of the water, around wet pull rolls to more thoroughly mix the adhesive into the fibers of the cord, followed by drying the cord by application of heat, it has been experienced that such squeeze and pull rolls can become contaminated. The contamination on the rolls can consist of, for example, various residues, dried adhesive deposits, and the like, which necessitates periodic shut down of the equipment for clean up purposes.

DESCRIPTION OF INVENTION

In accordance with this invention, an apparatus for treating a plurality of individual cords of textile material as they move, under tension, in spaced apart relationship along a predetermined path comprises, sequentially along said path, (A) a means for applying an aqueous solution, or mixture, of adhesive to said cords, (B) a squeeze roll station composed of at least two rotating cylindrical rolls positioned in a substantially vertical plane around which said cords pass in a substantially serpentine path on a single pass basis and in the same direction as the rotation of the roll around which thus are passing, where at least two adjacent rolls rotate in opposite directions and are positioned so that they press cords between them to remove a substantial amount of said aqueous solution or mixture from the cords, (C) a pull roll station composed of at least two spaced apart rotating cylindrical pull rolls, where at least two adjacent pull rolls rotate in opposite directions, around which said cords pass in a substantially serpentine path on a single pass basis in the same direction as the rotation of the roll about which they are passing and (D) a station for heating and drying said cord; and is characterized by an improvement in which a first rigidly contained elastomeric rubber squeeze bar is loosely positioned to lightly contact the breadth of the cords on the ascending surface of at least one of said squeeze rolls to affect a degree of liquid removal from the cords and a second rigidly contained elastomeric rubber squeege is loosely positioned to lightly contact the breadth of the cords on the ascending surface of at least one of said pull rolls to affect a degree of removal of foamed liquid or material which may have formed on the cord in the pull roll station.

In further accordance with this invention a method of treating a plurality of individual cords of textile material as they move, under tension, in spaced apart relationship along a predetermined path comprises sequentially along said path, (A) applying an aqueous solution or mixture of adhesive to said cords, (B) treating said cords in a squeeze roll station composed of at least two rotating cylindrical rolls having horizontal axes positioned in a substantially vertical plane around which said cords pass in a substantially serpentine path on a single pass basis and in the same direction as the rotation of the roll around which they are passing, at least two adjacent rolls rotate in opposite directions and are positioned so that they press cords between them to remove a substantial amount of said aqueous solution or mixture from the cords, (C) then treating the cords in a pull roll station composed of at least two spaced apart rotating cylindrical pull rolls, where at least two adjacent pull rolls rotate in opposite directions, around which said cords pass in a substantially serpentine path on a single pass basis in the same direction as the rotation of the roll about which they are passing and (D) drying the cord by heating; and is characterized by an improvement in which liquid is removed from the cord in the squeeze roll station by a first rigidly contained elastomeric rubber squeege which is loosely positioned to lightly contact the breadth of the cords on the ascending surface of the upper half of at least one squeeze roll and in which foamed liquid or material which may have formed on the cord in the pull roll station is removed in said pull roll station by a second rigidly contained elastomeric rubber squeege loosely positioned to lightly contact the breadth of the cords on the ascending surface of the upper half of at least one pull roll.

For further understanding of the invention, reference may be made to the drawing in which.

Figure 1:
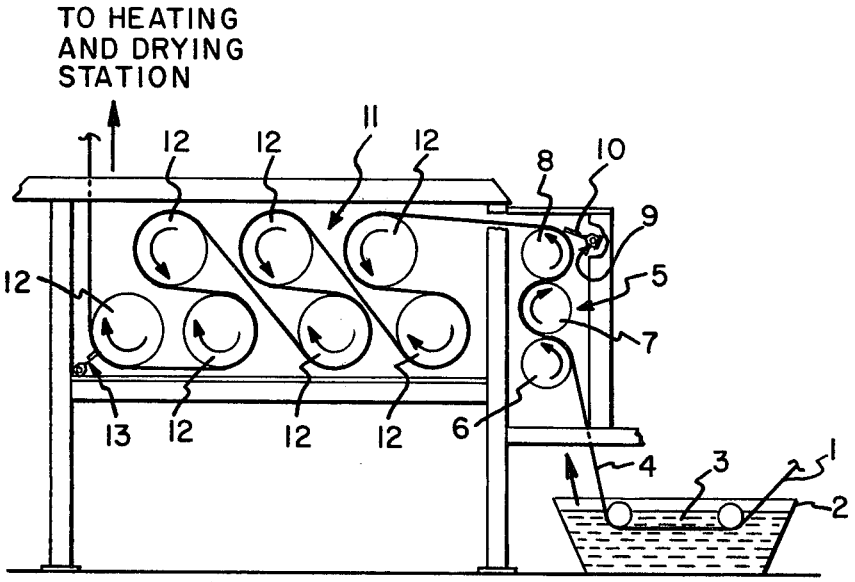
FIG. 1 is a schematic representation of a portion, or segment, of a continuous cord treatment apparatus directed to cord which has been dipped in an aqueous bath and is passed, under tension, sequentially through squeeze rolls, then through wet pull rolls and on to a dewebbing chamber.

Inspection of the drawings shows a continuous treatment of tire cord 1. In particular, the cord 1 is drawn through a saturator tank 2 which contains an aqueous dip solution/mixture of an adhesive composition 3. The dipped cord 4 having the aqueous coating thereon is fed to squeeze roll station 5 shown as containing three vertically positioned rolls 6, 7, and 8 with horizontal axes vertically positioned with respect to each other. The cord 4 is fed, under tension and through a substantially serpentine path, around and between the said squeeze rolls as shown in the drawing. The squeeze rolls are positioned so that they are pressed against the cord as it travels between them, thereby squeezing out a portion of the aqueous solution which is allowed to return to the saturator tank 2.

Figure 2:
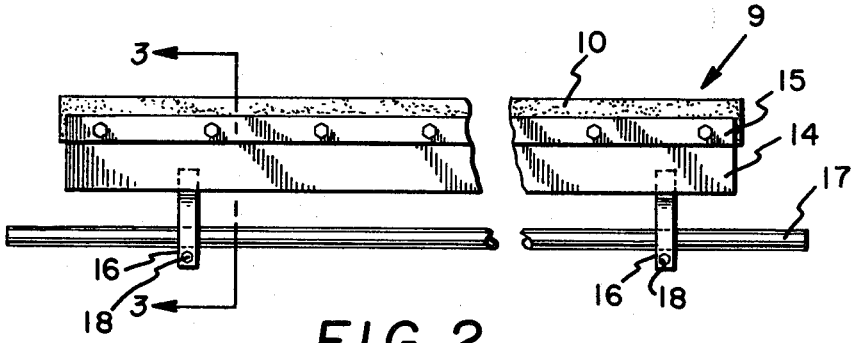
FIG. 2 is an enlarged view of a squeege assembly applied both to a squeeze roll and to a pull roll.
Figure 3:
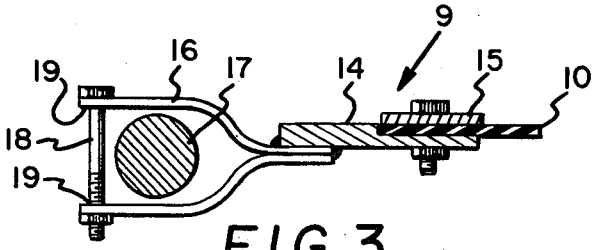
FIG. 3 is a side view of the squeeze assembly taken at 3—3 from FIG. 2.

Against the upper squeeze roll 8 is positioned a squeege assembly 9 which is more clearly shown in FIG. 2 and FIG. 3. The rubber blade 10 of the squeege assembly 9 rests lightly against the cord 4, essentially by its own weight on the ascending surface and removes additional aqueous solution from the cord 4, somewhat in the nature of a doctoring effect. The squeege tends to prevent excess aqueous solution from passing with the cord 4 to the next stage or station, thereby reducing rate of contamination of subsequent wet pull rolls. Further, it is anticipated that less pressure need be applied against the cord by the squeeze rolls with attendant benefits.

From the squeeze roll station 5 the cord 4 passes through the wet pull roll station which contains seven spaced apart rolls 12 around which the cord passes under tension in a substantially serpentine path. The rolls 12 are positioned in a slanted, staggered fashion extending in a horizontal direction.

As the cord 4 passes around the last roll 12, another squeege bar assembly 13 is positioned to rest lightly essentially by its own weight against the cord 4 on its ascending surface to remove foam and material which might have formed on the cord in the wet pull station 11.

The cord is then passed through a dewebber station, where it is dried by application of heat, and hence through other processing stations, until the cord treatment is completed. The cord is then used as rubber reinforcement.

Reference to FIG. 2 and FIG. 3 shows the important squeege assembly bar 9 also representative of assembly 13. In these figures, it is seen that the squeege assembly consists of a longitudinal gum rubber blade or bar 10 rigidly attached to or contained by a metal bar 14 with the aid of a metal strip 15. The metal strip-mounted rubber blade, in turn, is attached to two U-shaped metal mounting members 16. The mounting members 16 are loosely fitted around a fixed stationary circular cross-sectioned, mounting bar 17 and a pin or bolt 18 inserted through holes 19 in the mounting member 16, thereby loosely attaching the assembly to the mounting bar 17.

It can easily be recognized that the functional design of this squeege assembly with its purposeful loose coupling to the mounting bar 17 combined where it only lightly rests against the treated cord 4 as it passes around roll 8 facilitates an enhanced treatment of the cord 4 since it can substantially respond to variations in thickness, etc., in the cord 4 without necessitating external manipulation.

It should be appreciated that the cords are moved on their predetermined path under tension provided by suitable means. Such means is conventionally accomplished by power driving the rotating rolls at controlled speeds.

In this respect, greater tension is generally applied in the wet pull roll station than in the squeeze roll station, typically resulting in some slippage of the cord against individual pull rolls. Indeed the stress applied to the cord, possibly alternately to one side and than to the other of the cord, has been observed to create a type of foam on the cord for which it is desired to remove by the squeege blade or bar assembly.

The invention has been specifically described with respect to treatment of a plurality of cords moving in parallel spaced relationship. It will be apparent that the invention is not limited to treating cords in weftless relationship but may also be used to advantage with cords which have been united by light pick or transverse cords. Moreover, the invention is not limited to treatment of any predetermined number of cords or with any particular liquid although the invention has its greatest utility in the preparation of cords for incorporation in elastomeric materials and wherein the treating liquid is adhesive in nature.

While certain representative embodiments and details have been shown for the purpose of illustrating the invention, it will be apparent to those skilled in this art that various changes and modifications may be made therein without departing from the spirit or scope of the invention.

I claim:

1. In an apparatus for treating a plurality of individual cords of textile material as they move, under tension, in spaced apart relationship along a predetermined path which comprises, sequentially along said path, (A) a means for applying an aqueous solution, or mixture, of adhesive to said cords, (B) a squeeze roll station composed of at least two rotating cylindrical rolls with horizontal axes positioned in a substantially vertical plane relative to each other around which said cords pass in a substantially serpentine path on a single pass basis and in the same direction as the rotation of the roll around which they are passing, where at least two adjacent rolls rotate in opposite directions and are positioned so that they press cords between them to remove a substantial amount of said aqueous solution or mixture from the cords, (C) a pull roll station composed of at least two spaced apart rotating cylindrical pull rolls, where at least two adjacent pull rolls rotate in opposite directions, around which said cords pass in a substantially serpentine path on a single pass basis in the same direction as the rotation of the roll about which they are passing and (D) a station for heating and drying said cord; the improvement in which a first rigidly contained elastomeric rubber squeege bar is loosely positioned to lightly contact the breadth of the cords on the ascending surface of at least one of said squeeze rolls to affect a degree of liquid removal from the cords and a second rigidly contained elastomeric rubber squeege is loosely positioned to lightly contact the breadth of the cords on the ascending surface of at least one of said pull rolls to affect a degree of removal of foamed liquid or material which may have formed on the cord in the pull roll station.

2. In a method of treating a plurality of individual cords of textile material as they move, under tension, in spaced apart relationship along a predetermined path which comprises sequentially along said path, (A) applying an aqueous solution or mixture of adhesive to said cords, (B) treating said cords in a in a squeeze roll station composed of at least two rotating cylindrical rolls having horizontal axes positioned in a substantially vertical plane relative to each other around which said cords pass in a substantially serpentine path on a single pass basis and in the same direction as the rotation of the roll around which they are passing, where at least two adjacent rolls rotate in opposite directions and are positioned so that they press cords between them to remove a substantial amount of said aqueous solution or mixture from the cords, (C) then treating the cords in a pull roll station composed of at least two spaced apart rotating cylindrical pull rolls, where at least two adjacent pull rolls rotate in opposite directions, around which said cords pass in a substantially serpentine path on a single pass basis in the same direction as the rotation of the roll about which they are passing and (D) drying the cord by heating; the improvement in which liquid is additionally removed from the cord in the squeeze roll station by a first rigidly contained elastomeric rubber squeege which is loosely positioned to lightly contact the breadth of the cords on the ascending surface of the upper half of at least one squeeze roll and in which foamed liquid or material which may have formed on the cord in the pull roll station is removed in said pull roll station by a second rigidly contained elastomeric rubber squeege loosely positioned to lightly contact the breadth of the cords on the ascending surface of the upper half of at least one pull roll.

* * * * *